US006202323B1

(12) United States Patent
Möller

(10) Patent No.: US 6,202,323 B1
(45) Date of Patent: Mar. 20, 2001

(54) APPARATUS FOR TREATING MATERIAL WEBS

(75) Inventor: Thorsten Möller, Seevetal (DE)

(73) Assignee: Pagendarm Technologie GmbH, Halstenbek (DE)

( * ) Notice: Subject to any disclaimer, the term of this patent is extended or adjusted under 35 U.S.C. 154(b) by 0 days.

(21) Appl. No.: 09/267,153

(22) Filed: Mar. 11, 1999

(30) Foreign Application Priority Data

Mar. 24, 1998 (DE) ..... 198 12 776

(51) Int. Cl.[7] ..... F26B 13/06

(52) U.S. Cl. ..... 34/631; 34/633; 34/639; 34/655

(58) Field of Search ..... 34/629, 631, 632, 34/633, 636, 638, 639, 644, 653, 655; 226/95, 97, 97.3; 239/443, 444, 445, 446, DIG. 7

(56) References Cited

U.S. PATENT DOCUMENTS

| | | | | |
|---|---|---|---|---|
| 3,002,700 | | 10/1961 | Möhring | 239/455 |
| 4,055,003 | * | 10/1977 | Sack | 34/641 X |
| 4,606,137 | * | 8/1986 | Whipple | 34/242 X |
| 4,689,895 | * | 9/1987 | Taylor et al. | 34/122 X |
| 4,698,914 | * | 10/1987 | Shu et al. | 226/97 X |
| 4,785,986 | | 11/1988 | Daane et al. | 4/226 |
| 5,070,627 | * | 12/1991 | Zagar | 34/633 |
| 5,134,788 | * | 8/1992 | Stibbe et al. | 34/641 |
| 5,156,312 | * | 10/1992 | Kurie | 226/97 |
| 5,395,029 | | 3/1995 | Kurie | 226/97 |
| 5,689,900 | * | 11/1997 | Takayama et al. | 34/631 |

FOREIGN PATENT DOCUMENTS

| | | |
|---|---|---|
| 316982 | 8/1974 | (AT) . |
| 1145572 | 3/1963 | (DE) . |
| 2020430 | 12/1971 | (DE) . |
| 2326430 | 12/1974 | (DE) . |
| 2615258 | 10/1977 | (DE) . |
| 2911812A1 | 11/1979 | (DE) . |
| 315212C2 | 12/1988 | (DE) . |
| 0247547A2 | 12/1987 | (EP) . |
| 0196107A2 | 10/1988 | (EP) . |
| 0532486A1 | 3/1993 | (EP) . |
| 2461218 | 1/1981 | (FR) . |

* cited by examiner

*Primary Examiner*—Stephen Gravini
(74) *Attorney, Agent, or Firm*—Abelman, Frayne & Schwab

(57) ABSTRACT

Apparatus for treating material webs.

For the purpose of treating material webs (10), especially drying them, these are acted on by a (heated) gaseous medium via slot nozzles (13, 14) in the area of a drying chamber (11). Depending on the operating conditions and the material web, the flow conditions of the gaseous medium must be capable of being adapted in the area of the material web, since the material web (10) may otherwise be adversely affected, for example as a result of an excessive supply of heat.

The slot nozzles (13, 14) are designed in such a way that, in order to change the flow conditions, the exit of the gaseous medium from different nozzle slots can be adjusted by means of a control device, especially a slide device. By means of different outflow directions of the nozzles, an influence can be exerted on the flow conditions and the supply of heat, depending on the operating condition of the drying chamber (11).

The apparatus is suitable for treating material webs, for example for drying coated material webs.

11 Claims, 6 Drawing Sheets

APPARATUS FOR TREATING MATERIAL WEBS

The invention relates to an apparatus for treating thin material webs, especially those made of paper, film or the like, using a gaseous medium, especially feed air, in a drying chamber, through which the material web can be conveyed, preferably continuously, and in which the medium is directed onto the material web from above and/or from below via a number of transversely oriented slot nozzles.

The drying of the material web, which is preferably coated, is performed by the gaseous medium, which is directed onto the material web by means of transversely oriented slot nozzles. In addition, in order to increase the drying effect, the gaseous medium or parts of the drying equipment or parts of the slot nozzles may be heated. The flow conditions in the area of the material web and the supply of heat to the latter are predefined here by the design configuration of the slot nozzles and thus cannot be adapted to different operating conditions, for example different material webs or transport speeds of the same. If the flow conditions or the supply of heat are not configured optimally, this may have an adverse effect on the material web, for example insufficient drying or damage. If the transport speed is reduced (for production reasons) or the web is brought to a standstill, the latter may burn if heat continues to be supplied to it.

The invention is thus based on the object of improving the flow conditions between the slot nozzles and the material web under variable operating conditions.

In order to achieve this object, the apparatus according to the invention is characterized in that at least some of the slot nozzles have a number of nozzle slots, and in that the volume flow of the gaseous medium through at least one nozzle slot can be adjusted by a control device. By means of the control device, in the extreme case the inflow can be changed over in this way from one nozzle slot to a different nozzle slot. By this means, the position at which the gaseous medium acts on the web and, if necessary, the direction of this action can be changed by the control device.

In a further refinement of the invention, the control device has at least one slide device. The slide device preferably has a basic body and a covering body each having at least one opening which, when the slide device is opened, form at least one common opening for the gaseous medium to pass through to at least one nozzle slot, and the common opening can be closed by changing the relative position of the basic body and the covering body. While the drying apparatus is operating, it is therefore possible in a simple way, by manually or automatically changing the relative position of the basic body and the covering body, for example by displacing one of the bodies, to change the action on the material web of the gaseous medium and thermal energy. In addition to simple operability, a slide device of this type has the advantage that it can be produced in a simple way.

The nozzle slots of a slot nozzle preferably have different outflow directions of the gaseous medium. For the maximum supply of heat to the material web, the latter may rest on a heated roll. In the event of a (temporary) standstill of the material web and of the heated roll, overheating of the material web in the contact area with the roll may be prevented by the gaseous medium being fed to the contact area between the roll and the material web, tangentially in relation to the roll, by activating a tangential nozzle, so that an air cushion is built up between the roll and the material web. At the same time, the thermal energy of the roll is dissipated by the air cushion in the tangential direction by means of the gaseous medium.

Preferred developments of the invention emerge from the subclaims and the description. Exemplary embodiments of the invention are explained in more detail below using the drawings, in which:

Figure 1:
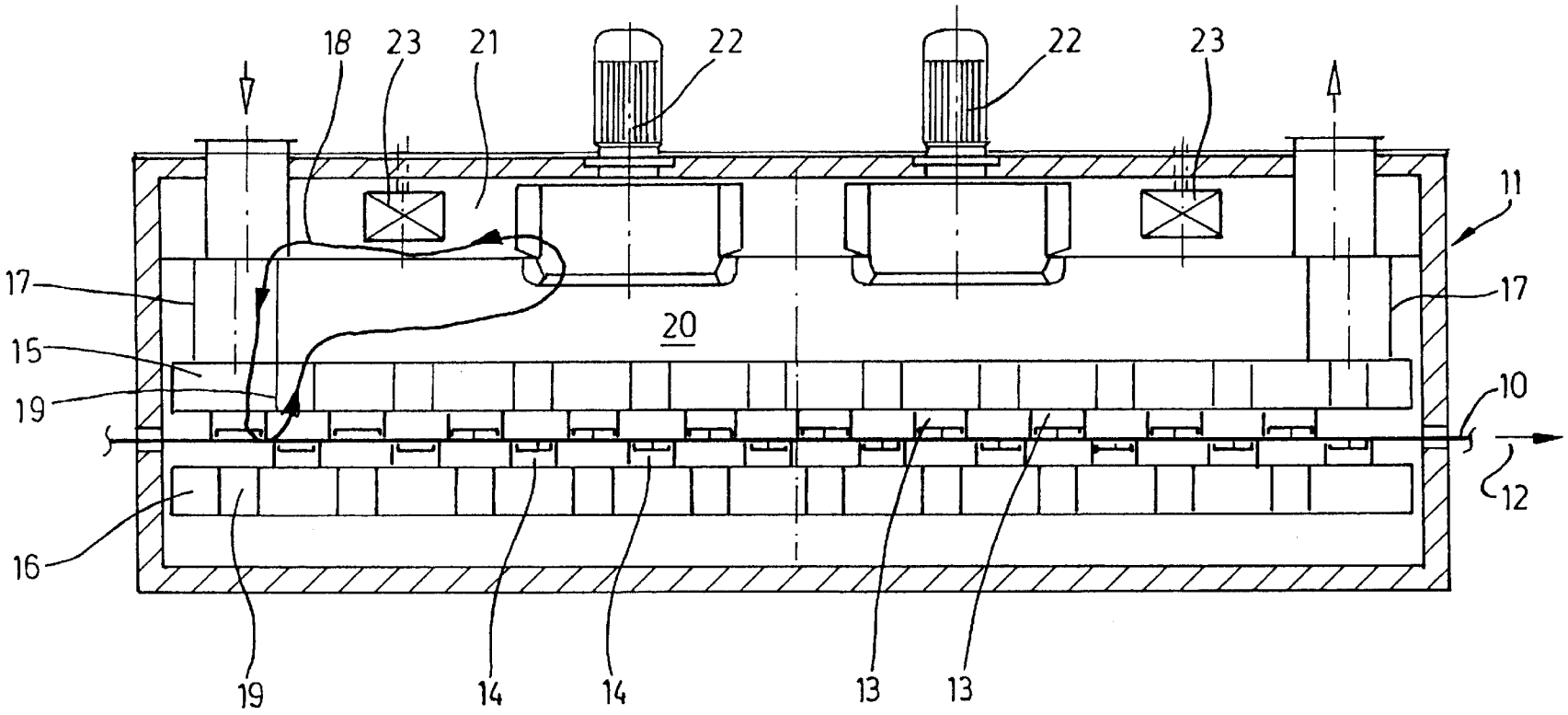
FIG. 1 shows a longitudinal section of a drying apparatus.
Figure 2:
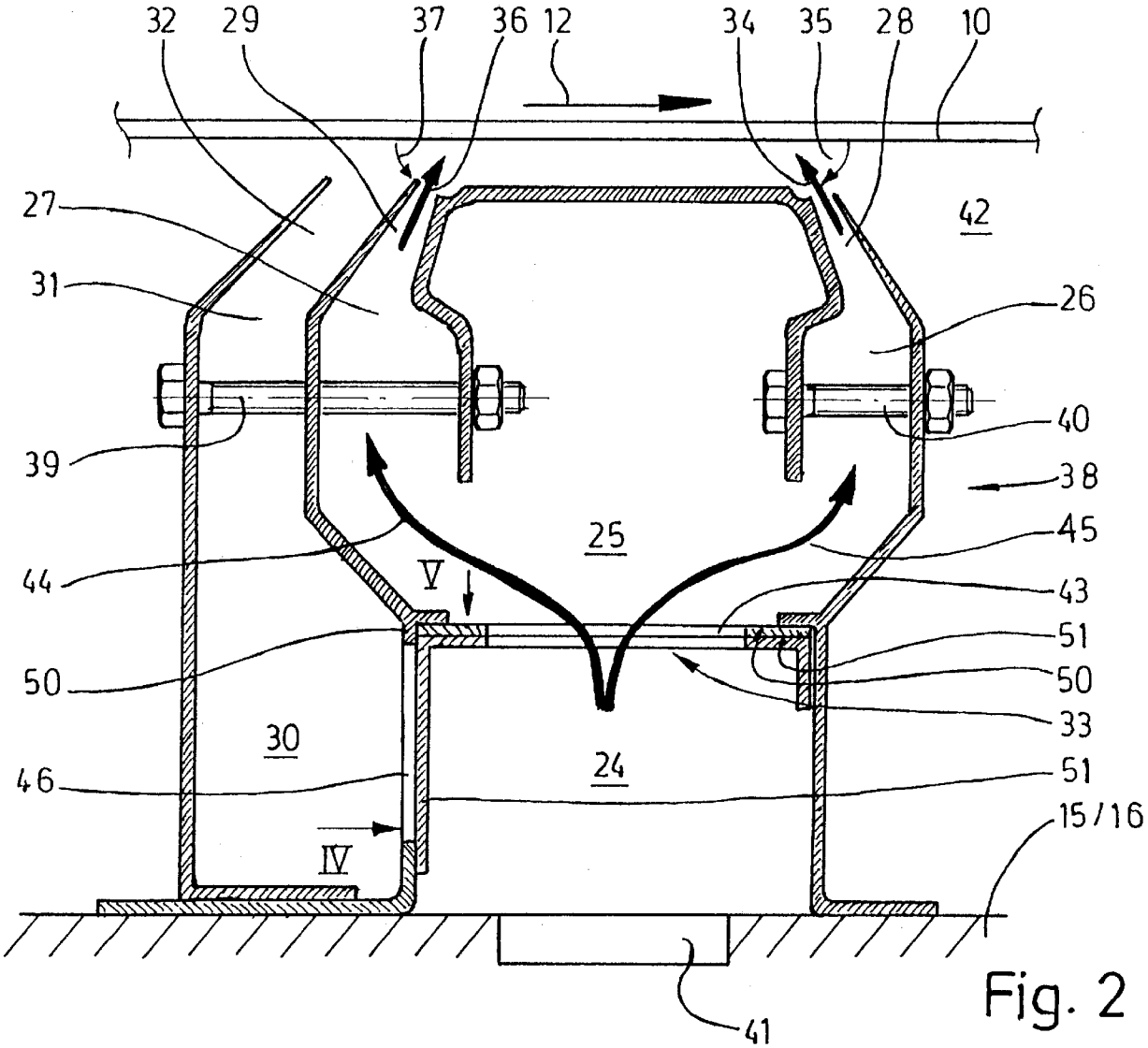
FIG. 2 shows a cross section of a slot nozzle.
Figure 3:
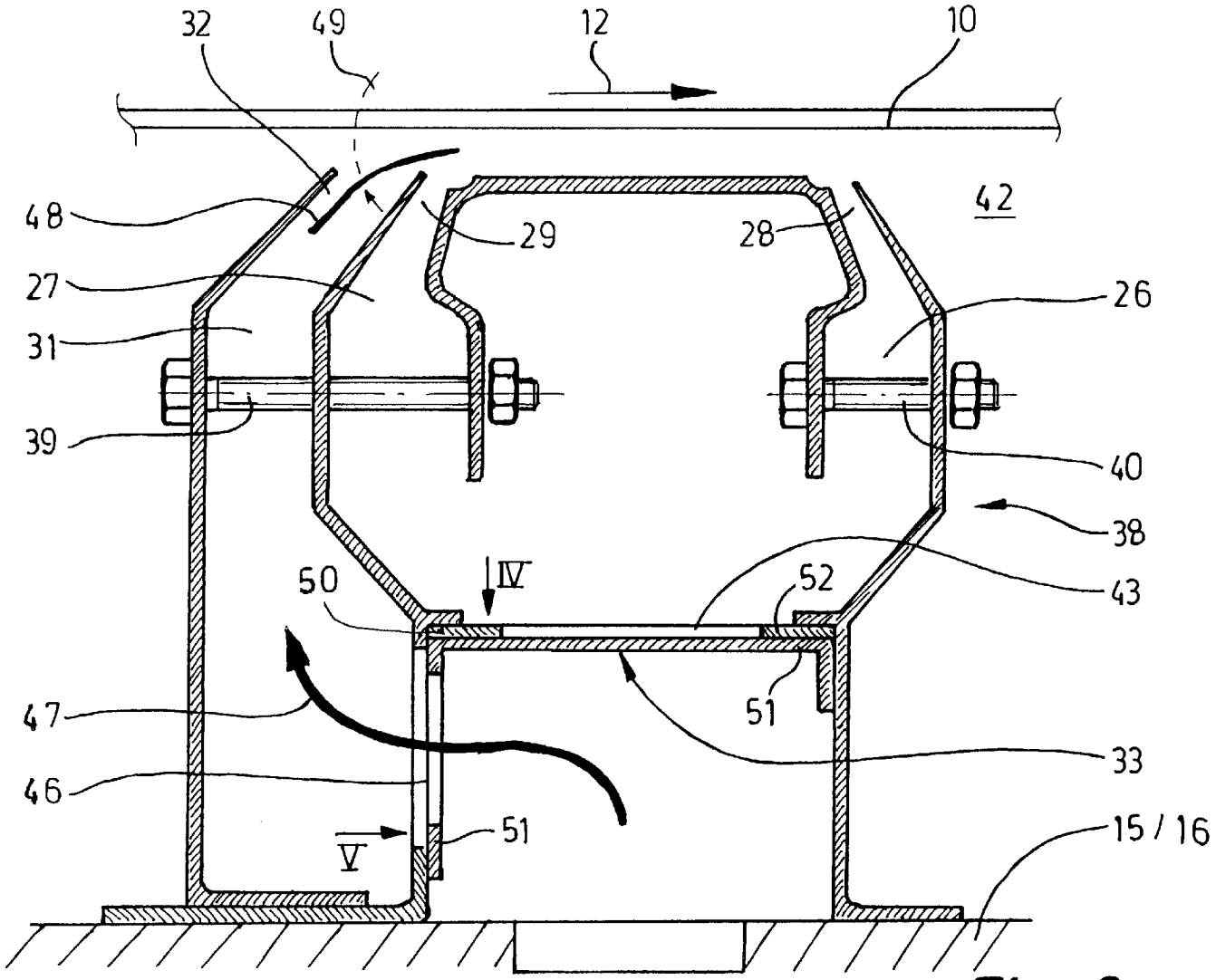
Figures 4, 5:
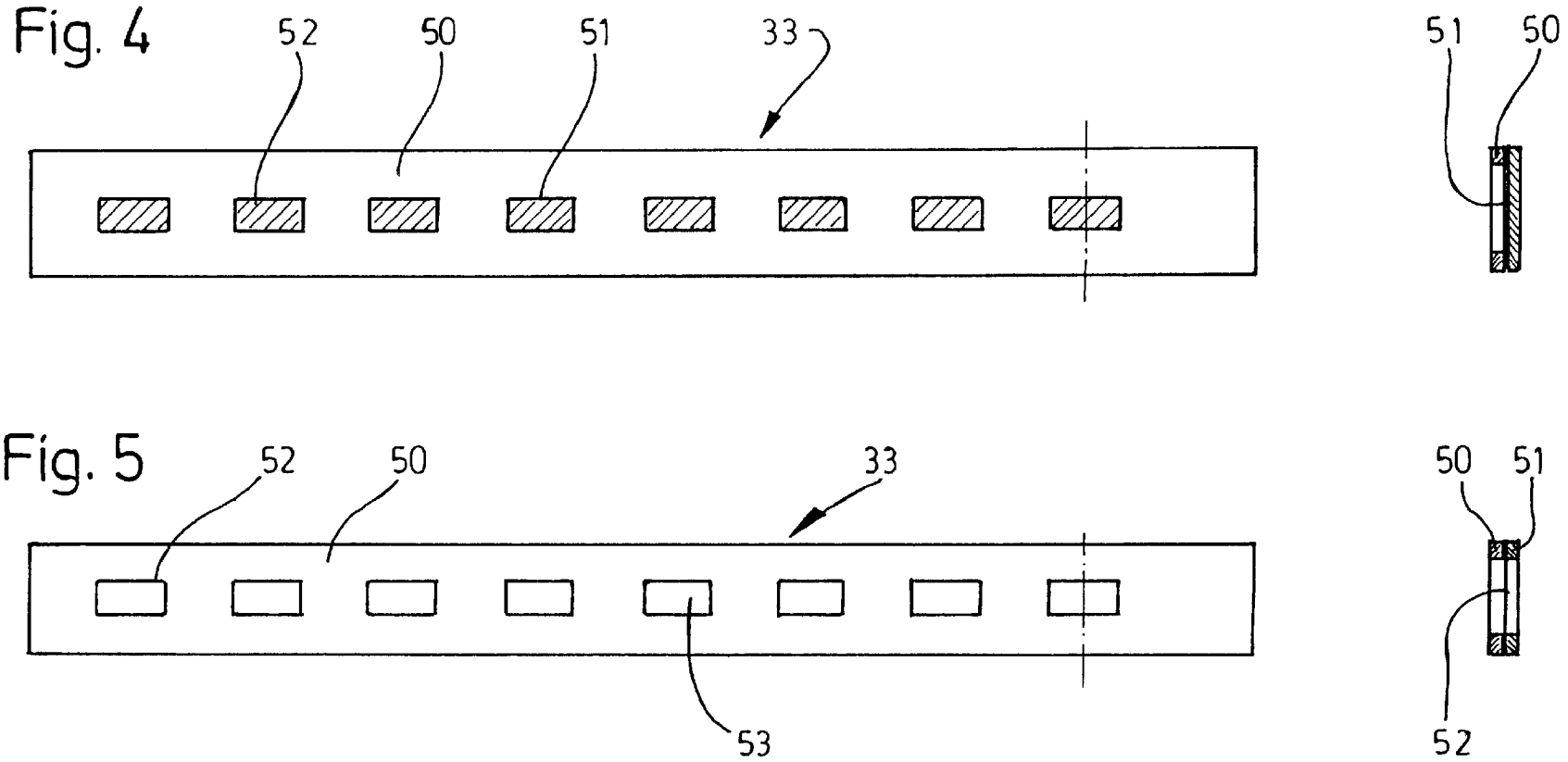
Figure 6:
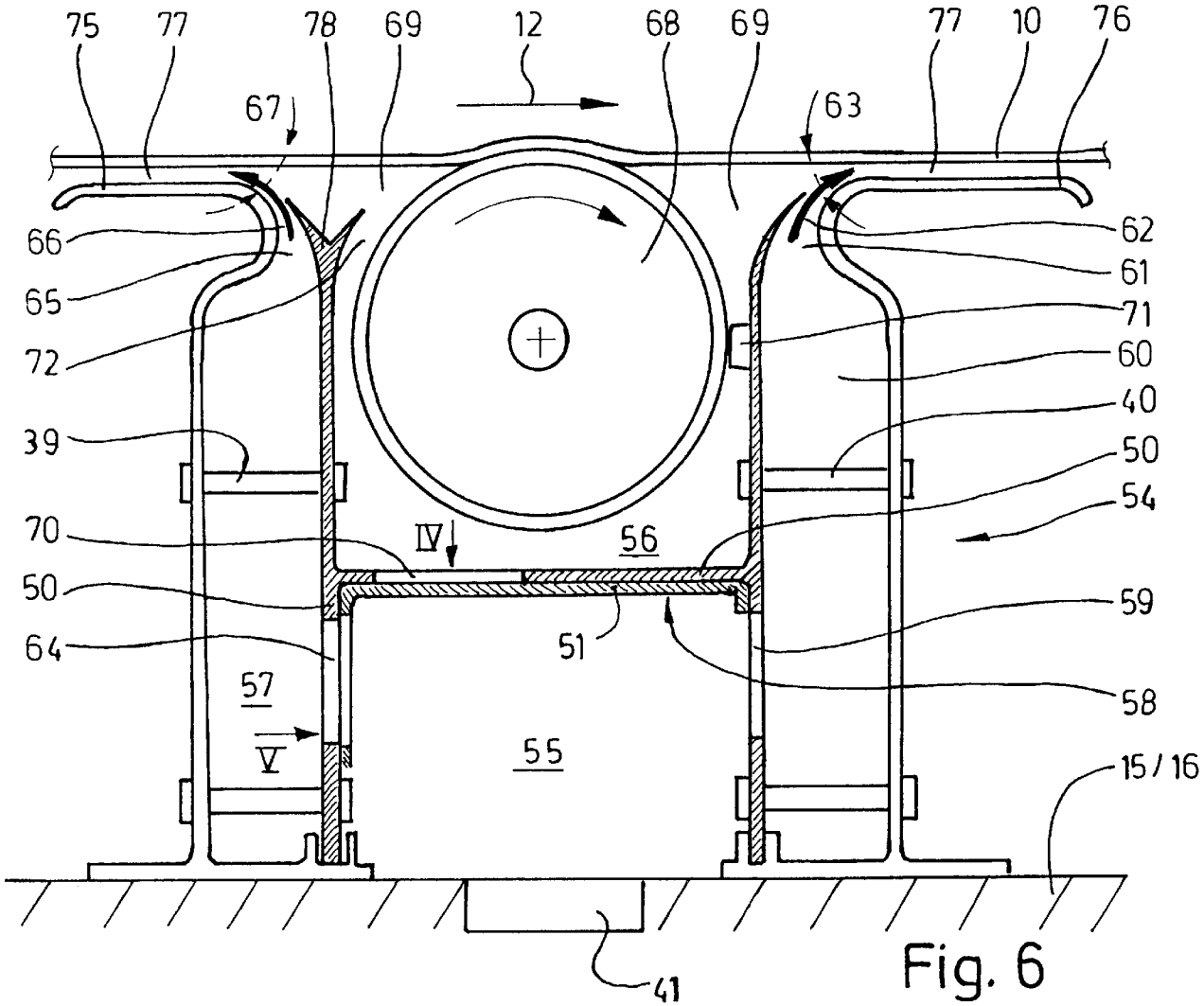
Figure 7:
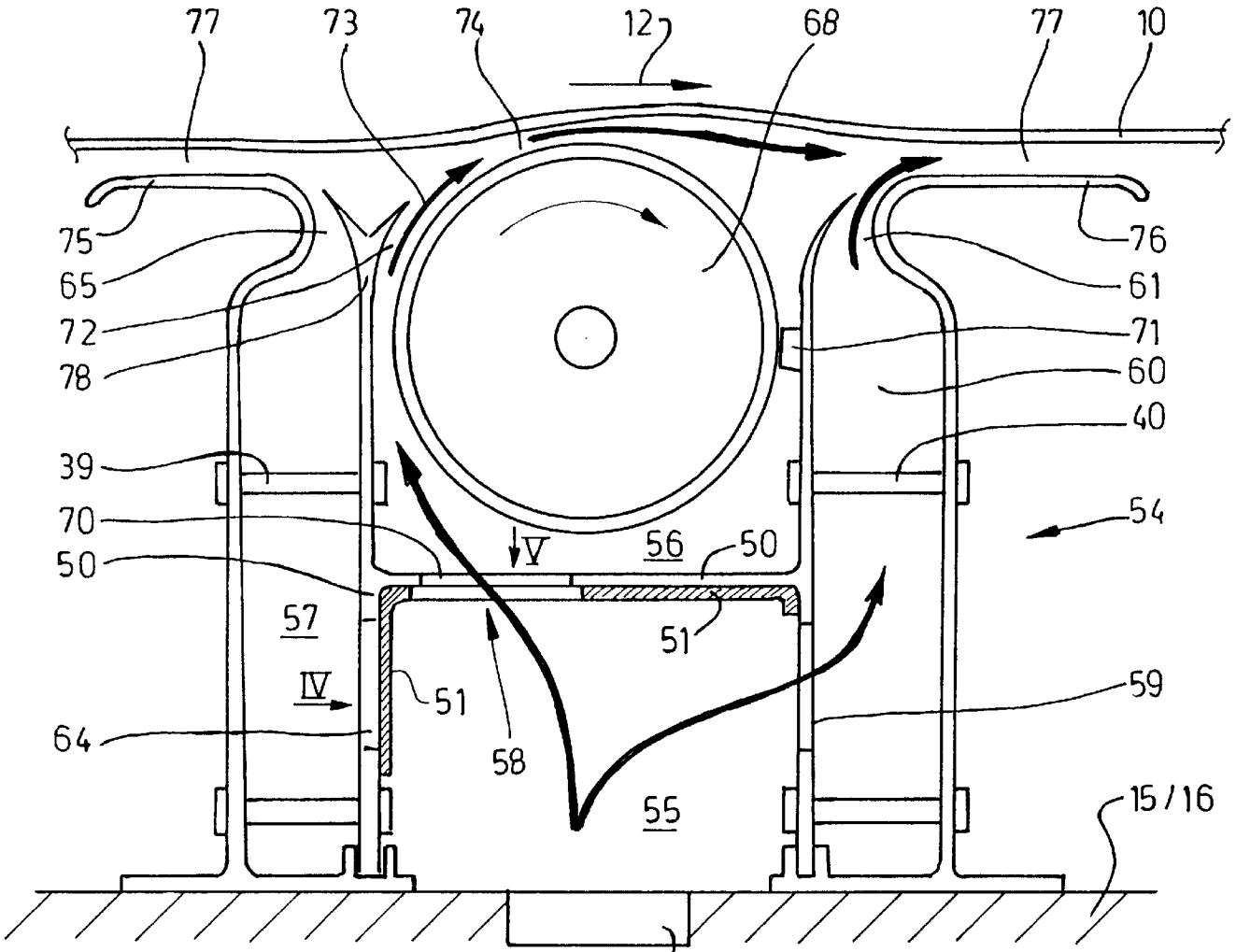

FIG. 3 shows a cross section of a slot nozzle according to FIG. 2 with a changed position of the slide device, FIG. 4 shows the view IV of the slide device, FIG. 5 shows the view V of the slide device, FIG. 6 shows a cross section of a further embodiment of the slot nozzle with heated roll and, FIG. 7 shows a slot nozzle with heated roll according to FIG. 6 with a changed position of the slide device.

The treatment of the (thin) material web 10 takes place in a treatment or drying chamber 11. The material web 10 is led through this chamber in the transport direction 12, preferably continuously. In the drying chamber 11, the material web 10 is acted on by a gaseous medium, especially using (heated) air, specifically feed air. This is directed onto the upper and lower side of the material web 10 by means of a number of nozzles, specifically upper slot nozzles 13 and lower slot nozzles 14, respectively. The upper slot nozzles 13 are assigned to a horizontal upper nozzle box 15 in parallel rows which are oriented transversely in relation to the transport direction 12 of the material web 10; the lower slot nozzles 14 are correspondingly assigned to a lower nozzle box 16. The upper nozzle box 15 and the lower nozzle box 16 are oriented in parallel here and arranged at such a distance that a transport channel for the material web 10 is produced between the upper slot nozzles 13 and the lower slot nozzles 14, preferably forming a (horizontal) gap. The gaseous medium is fed to the upper and lower nozzle boxes 15, 16 via feed-air ducts 17.

The feed air moves within the drying chamber 11 in a (closed) circulation 18: after being fed to the nozzle box 15 through the feed-air ducts 17, the feed air emerges through the slot nozzles 13 into the area of the material web and is fed once more to the feed ducts 17 via extraction ducts 19, a collecting space 20 and a flow duct 21 (if appropriate, with air exchange with the surrounding area). The movement of the feed air is effected by a fan 22, heating of the feed air can be carried out by means of the air heater 23. In a corresponding way, the feed air is fed to the lower nozzle box 16 in a further closed circulation.

FIG. 2 illustrates a section through a slot nozzle 13, 14, the section having been made in the transport direction 12 of the material web 10. This embodiment of the slot nozzle essentially has a feed area 24, an antechamber 25 and nozzle slots 28, 29 which are connected to the said antechamber by open flow ducts 26, 27, as well as a side chamber 30 having a nozzle slot 32 connected to the latter via a flow duct 31. The feed area 24 is connected via the slide device 33 to the antechamber 25, on the one hand, and to the side chamber 30, on the other hand. The outlet openings of the continuous or interrupted nozzle slots 28, 29, 32 are located approximately in a horizontal plane. With reference to the transport direction 12, the nozzle slots 28, 29, 32 are oriented transversely to this direction and are located one behind another in a parallel orientation.

The gaseous medium flows out of the nozzle slot 28 in the outflow direction 34 at an angle $\alpha_1$ (35) to the material web 10. Located upstream of the nozzle slot 28, in the transport direction 12, is the nozzle slot 29, from which the gaseous medium emerges in the direction of the material web 10 in the outflow direction 36 at an angle $\alpha_2$ (37) to the said material web. The outflow direction 34 has a component counter to the transport direction 12; the outflow direction 36 has a component in the transport direction 12. The outflow directions 34, 36 are therefore directed towards each other.

If the feed air is guided in this way, the volume flows emerging from the nozzle slot 28, on the one hand, and the nozzle slot 29, on the other hand, encounter each other in the interspace between the nozzle slots 28, 29 in the region of the material web 10, which results in a low flow velocity.

The slot nozzle 38 is essentially formed using extruded sections, for example made of aluminium, which, with the cross sections illustrated in FIG. 2, are oriented with their longitudinal extent transverse to the transport direction 12 and by means of the outer and inner faces of which the feed area 24, the antechamber 25, the side chamber 30, the flow ducts 26, 27, 31 and the nozzle slots 28, 29, 32 are formed. The extruded sections are connected to one another by a number of bolts 39, 40, and are fixed in the position illustrated in FIG. 2. The slot nozzle 38 is connected on the underside to the underside of the upper nozzle box 15 or the upper side of the lower nozzle box 16. The gaseous medium may be fed to the feed area 24 via one or more feed ducts 41 in the nozzle box 15, 16. Transporting the gaseous medium through the slot nozzle 38 is effected by increasing the pressure in the feed duct 41 with respect to the discharge area 42.

In that position of the slide device 33 which is illustrated in FIG. 2, an opening 43 between the feed area 24 and the antechamber 25 is opened, so that the gaseous medium flows in the direction of the slot nozzles 28, 29 in the flow directions 44, 45. A further opening 46 between the feed area 24 and the side chamber 30 is closed in that position of the slide device 33 which is sketched in FIG. 2, so that no gaseous medium emerges from the nozzle slot 32.

By operating the slide device 33 in a suitable way, the opening 43 may be closed, according to FIG. 3, so that the feed of air to the nozzle slots 28, 29 is interrupted. At the same time, the opening 46 is opened, so that the feed air enters the side chamber 30 through this opening in the flow direction 47, and emerges through the nozzle slot 33 in the outflow direction 48 at an angle $\beta$ (49) to the material web. The outflow direction 48 has a component in the transport direction 12. The outflow direction 48 is oriented more in the direction of the material web than the outflow directions 34, 36, so that it is true that $\beta<\alpha_1, \alpha_2$. The fact that the opposite flow according to FIG. 2 is missing means that, in the position of the slide device 33 according to FIG. 3, the gaseous medium can emerge from the slot nozzle at a tangent to the material web 10. The flow velocities of the gaseous medium in the area of the material web 10 are therefore greater in FIG. 3 than for the position of the slide device according to FIG. 2, so that the result is a changed transfer of heat to the material web.

In addition to the illustrated extreme positions of the slide device 33 in FIG. 2 and FIG. 3, it is also conceivable for the openings 43, 46 to be opened only partially, so that the flow conditions can be adapted in a sensitive manner to the required operating conditions.

The slide device 33 is formed by an angular basic body 50 and an angular covering body 51, which are L-shaped in the present case and are placed inside each other with contact between the corresponding legs. The vertical legs form a connection between the feed area 24 and the side chamber 30. The horizontal legs of the basic body 50 and of the covering body 51 form a connection between the feed area 24 and the antechamber 25. The basic body 50 and the covering body 51 each have a number of rectangular cutouts on each leg, these cutouts being located in a row on each leg and being equally spaced apart. If the rectangular cutouts 52 on mutually contacting legs of the basic body 50 and of the covering body 51 are arranged so that they align, in this connection see FIG. 5, the medium is able to enter the antechamber 25 and the side chamber 30 from the feed area 24 through the openings 53 which are formed. If the rectangular cutouts 52 on the two legs of the basic body 50 (covering body 51) are arranged so that they are offset, it is then possible for the opening 46 to be opened at the same time as the opening 43 is closed.

Alternatively, it is also conceivable for the openings 43 and 46 to be capable of being operated by separate slide devices. Furthermore, other cutouts 52 are also conceivable, for example circular cutouts. In order to operate the slide device, the basic body 50 and/or the covering body 51 may be assigned at least one operating element, for example a rod which projects sideways out of the drying chamber 11 may be welded onto the said body. A ring may be fitted to the said rod and may be used to operate the slide device 33 by hand.

An alternative embodiment of a slot nozzle is illustrated in FIG. 6. This slot nozzle 54 is connected to the upper nozzle box 15 or to the lower nozzle box 16 in a manner comparable with the slot nozzle 38. The slot nozzle 54 likewise has a feed area 55, an antechamber 56 and a side chamber 57. By means of the slide device 58, in a manner corresponding to the slot nozzle 38, it is possible for the access of the gaseous medium from the feed area 55 to the antechamber 56 and/or to the side chamber 57 to be controlled. Irrespective of the position of the slide device 58, feed air emerges from the feed area 55 through an opening 59 into a side duct 60, which feeds this air to a nozzle slot 61, from which the feed air flows out in the outflow direction 62 at an angle $\gamma_1$ (63) to the material web 10. The outflow direction 62 has a component in the transport direction 12. In that position of the slide device 58 which is sketched in FIG. 6, this device opens an opening 64 between the feed area 55 and the side chamber 57, so that the gaseous medium likewise emerges through the side chamber 57 from a nozzle slot 65 that is connected to the latter, with the outflow direction 66 at the angle $\gamma_2$ (67) to the material web. The outflow direction 66 has a component counter to the transport direction 12, so that the nozzle slots 61 and 65 are oriented in opposite directions. Arranged between the nozzle slots 61 and 65 and, respectively, the side duct 60 and the side chamber 57, are a rotating, heatable roll 68 and the antechamber 56. Here, the longitudinal axis of the roll 68 is oriented transversely to the transport direction of the material web, and the upper side of the outer surface is located approximately in the plane in which the material web 10 is transported. The fact that the outflow directions 62, 66 are oriented away from each other gives rise to a negative pressure in the areas 69 in the environment of the roll 68, as a result of which the material web is pressed against the roll, forming an acute wrap angle around the roll.

If the position of the slide device 58 is changed, the opening 64 may be closed, so that the feed of air to the nozzle slot 65 is interrupted. If the opening 70 is opened by the slide device 58, the feed air can enter the antechamber 56 from the feed area 55. In the antechamber, the feed air comes into contact with the rotating roll 68. On that side of the rotating roll 68 which is located downstream in the flow direction 12, the circulating flow around the roll is interrupted by a seal 71, which is located approximately at the three o'clock position. On the opposite side of the roll, that is to say on that side which is located upstream in the flow direction, the feed air is able to flow unimpeded around the roll 68 and out of a nozzle slot 72, which is formed by the roll 68 and an intermediate wall 78, in the outflow direction 73, approximately tangential to the rotating roll 68 or the material web 10, and with a flow component in the transport direction 12. As a result of the volume flow in the flow direction 52, an air cushion is formed between the material web 10 and the roll 68, so that a gap 74 is produced between the roll 68 and the material web 10. This is advantageous, for example, when, in the event of the material web 10 coming to a standstill, the supply of heat from the heated roll 68 to the material web is to be prevented.

In the areas of the slot nozzle 54 which are upstream and downstream in the transport direction, the said nozzle has outlet surfaces 75, 76 which are oriented approximately parallel to the plane in which the material web is transported, and in which the feed air is led away from the slot nozzle in a horizontal duct 77 formed between the outlet surfaces 75, 76 and the material web 10.

The slot nozzle 54 is likewise formed from extruded sections, preferably made of aluminium.

The slot nozzles 38, 54 are sealed off transversely in relation to the transport direction 12 in the end area of the extruded sections by means of common walls (not illustrated in the drawings) in such a way that the feed air can enter the slot nozzles 38, 54 only through the feed duct 41 and can leave these nozzles only via the nozzle slots 28, 29, 32 and 61, 65, 72, respectively.

What is claimed is:

1. An apparatus for treating a thin material webs using a gaseous medium, said apparatus comprising:

a plurality of slot nozzles disposed in a drying chamber along a direction of conveyance of said material web through said drying chamber, wherein each said slot nozzle includes a plurality of nozzle openings spaced along said conveyance direction for discharging said gaseous medium toward said material web and a plurality of feed openings for introducing said gaseous medium to be discharged through corresponding said nozzle openings, each said nozzle opening having a predetermined fixed width and extending transversely to said conveyance direction; and a control mechanism for adjusting the flow of said gaseous medium through at least one said feed opening, wherein said control mechanism comprises at least one closing member movable to plural positions, including a position for completely closing said feed opening.

2. An apparatus according to claim 1, wherein said control mechanism adjusts the flow of said gaseous medium through more than one said feed opening.

3. An apparatus according to claim 2, wherein:

each said slot nozzle includes an elongate hollow section extending transversely to said conveyance direction;

each said hollow section comprises a plurality of individual sections joined together to form a feed area in fluid communication with a source of said gaseous medium, an antechamber in fluid communication with said feed area through a first said feed opening and with at least one of said slot nozzles, and a side chamber in fluid communication with said feed area through a second said feed opening and with a different said slot nozzle; and said closing member includes a slide device moveable to different positions for selectively changing the areas of said feed openings, including closing said feed openings.

4. An apparatus according to claim 3, wherein said slide device extends in a longitudinal direction of said elongate hollow section and includes a covering body with at least one aperture disposed such that said slide device can be displaced within said hollow section to bring said covering body and said aperture into varying degrees of registration with said feed openings.

5. An apparatus according to claim 3, wherein:

each said slot nozzle includes at least two opposed said nozzle openings for directing said gaseous medium toward said material web with opposing flow components, said opposing nozzle openings being in fluid communication with said antechamber through a first said feed opening;

each said slot nozzle includes a third said nozzle opening flanking one of said opposed nozzle openings, said flanking nozzle opening being in fluid communication with said side chamber through a second said feed opening; and said slide device has an L-shaped cross-section having a first leg comprising said covering body for said first feed opening and a second leg comprising said covering body for said second feed opening.

6. An apparatus according to claim 2, further comprising a roll extending transversely of said material web for conveying said web through said drying chamber, wherein:

a first said nozzle opening is disposed upstream of said roll along said conveyance direction and a second said nozzle opening is disposed downstream of said roll along said conveyance direction;

said first nozzle opening is in fluid communication with an antechamber through a passage bounded on one side by a wall and on the other side by a circumferential surface of said roll, said antechamber including one of said feed openings; and said second nozzle opening is in fluid communication with a side duct including a different said feed opening.

7. An apparatus according to claim 6, wherein a third said nozzle opening is disposed upstream of said first said nozzle opening in said conveyance direction, said third nozzle opening including a different said feed opening separate from said first-mentioned and said second-mentioned feed openings.

8. An apparatus according to claim 7, wherein said roll is heated.

9. An apparatus according to claim 1, wherein said gaseous medium is hot air.

10. An apparatus according to claim 1, wherein said material web is continuous and is selected from the group comprising paper and films.

11. An apparatus according to claim 1, wherein said conveyance direction is substantially horizontal and said slot nozzles are disposed above and below said material web.

* * * * *